US007815485B2

(12) United States Patent
Moothedath et al.

(10) Patent No.: US 7,815,485 B2
(45) Date of Patent: Oct. 19, 2010

(54) POSE AND PLAY DOLLS

(75) Inventors: Sunil William Moothedath, Pleasanton, CA (US); Russell G. Rasmussen, Petaluma, CA (US); Paul S. Rago, Danville, CA (US); David B. Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 158 days.

(21) Appl. No.: 12/038,581

(22) Filed: Feb. 27, 2008

(65) Prior Publication Data

US 2009/0215358 A1 Aug. 27, 2009

(51) Int. Cl.
*A63H 11/00* (2006.01)

(52) U.S. Cl. ..... 446/352; 446/139; 446/175; 446/358; 446/376; 446/297; 446/298; 446/484; 273/317.1; 273/317.2; 273/317.3; 273/317.4; 273/317.5; 273/317.6; 273/317.7; 273/317.8; 273/317.9

(58) Field of Classification Search ..... 446/139, 446/358, 352, 376, 175, 297, 298, 484; 273/317.1–317.9
See application file for complete search history.

(56) References Cited

U.S. PATENT DOCUMENTS

| | | | | | |
|---|---|---|---|---|---|
| 612,541 | A | * | 10/1898 | Brown | 116/301 |
| 1,685,358 | A | * | 9/1928 | Harcourt | 40/416 |
| 2,184,675 | A | * | 12/1939 | Kehm | 40/457 |
| 2,637,936 | A | * | 5/1953 | Dale et al. | 40/411 |
| 3,500,577 | A | * | 3/1970 | Bart | 446/324 |
| 3,611,625 | A | * | 10/1971 | Sloop et al. | 446/354 |
| 3,660,931 | A | | 5/1972 | Gardel et al. | |
| 3,672,092 | A | * | 6/1972 | Tepper et al. | 446/359 |
| 3,672,674 | A | * | 6/1972 | Reed | 273/317.5 |
| 3,745,698 | A | * | 7/1973 | Davidson | 446/129 |
| 3,775,900 | A | | 12/1973 | Thorn et al. | |
| 3,858,353 | A | | 1/1975 | Glass et al. | |
| 3,862,513 | A | * | 1/1975 | Isaacson et al. | 446/381 |
| 3,888,023 | A | * | 6/1975 | Genin | 434/256 |
| 3,947,994 | A | | 4/1976 | Meyer et al. | |
| 3,988,855 | A | | 11/1976 | Crabtree et al. | |
| 4,003,158 | A | * | 1/1977 | Wolf et al. | 446/334 |
| 4,040,206 | A | * | 8/1977 | Kimura | 446/352 |
| 4,141,176 | A | * | 2/1979 | Flicker et al. | 446/361 |
| 4,157,633 | A | * | 6/1979 | Reiner et al. | 446/219 |
| 4,186,516 | A | * | 2/1980 | Ensmann | 446/238 |
| 4,306,720 | A | * | 12/1981 | Selengowski et al. | 273/317.5 |

(Continued)

*Primary Examiner*—Alvin A Hunter
*Assistant Examiner*—Alexander R Niconovich
(74) *Attorney, Agent, or Firm*—Blakely Sokoloff Taylor & Zafman LLP

(57) ABSTRACT

Pose and play dolls that will stand on a platform by magnetic attraction and dance with lifelike animation, but which may be removed from the stand for ordinary play. The dolls include animation powered from the platform through the legs of the doll. A motor in the doll animates the doll body, arms and head, with proportional feedback allowing control by a controller in coordination with music being played. The doll head may rotate or gyrate, and the arms swing as a unit or with the lower arms bending as the arms swing. In one form of platform simply rotates through controlled angles, again in coordination with the music being played. In another form of doll, the hips are configured to swing back and forth, and another form of platform controls the hip movement, again in coordination with the music being played. Various other features and capabilities are disclosed.

39 Claims, 17 Drawing Sheets

U.S. PATENT DOCUMENTS 4,601,672 A 7/1986 Cook et al.
4,657,518 A 4/1987 Kelley et al.
4,669,998 A 6/1987 Amici et al.
4,676,764 A * 6/1987 Yeu ..... 446/298
4,680,019 A 7/1987 Baerenwald et al.
4,723,932 A * 2/1988 Kelley et al. ..... 446/330
4,790,789 A 12/1988 Mathis
4,801,285 A * 1/1989 Yeu ..... 446/298
4,824,416 A * 4/1989 Chun-Hoi et al. ..... 446/298
4,828,530 A * 5/1989 Lee ..... 446/354
4,846,752 A 7/1989 Combs
4,875,886 A * 10/1989 Sung ..... 446/298
4,889,027 A * 12/1989 Yokoi ..... 84/635
4,944,708 A 7/1990 Kawabe
4,988,324 A 1/1991 Ryaa et al.
4,995,610 A * 2/1991 Paoletti ..... 463/8
5,013,276 A * 5/1991 Garfinkel ..... 446/14
5,024,611 A * 6/1991 Eckerle et al. ..... 446/268
5,044,960 A 9/1991 De Porteous
5,088,954 A 2/1992 Terzian et al.
5,147,238 A 9/1992 Kelley et al.
5,176,560 A * 1/1993 Wetherell et al. ..... 446/175
5,224,896 A * 7/1993 Terzian ..... 446/355
5,257,873 A 11/1993 Abbat
5,277,646 A * 1/1994 Fekete et al. ..... 446/491
5,308,276 A * 5/1994 Fogarty et al. ..... 446/288
5,378,187 A * 1/1995 Forbes et al. ..... 446/268
5,394,766 A * 3/1995 Johnson et al. ..... 74/490.01
5,412,890 A * 5/1995 Fechter ..... 40/414
5,495,151 A * 2/1996 Lu ..... 318/4
5,620,353 A * 4/1997 Lai ..... 446/136
5,727,982 A * 3/1998 Hurt ..... 446/352
5,779,515 A * 7/1998 Chung ..... 446/90
5,870,842 A * 2/1999 Ogden et al. ..... 40/411
5,911,617 A * 6/1999 Chou ..... 446/353
5,941,756 A * 8/1999 Chou ..... 446/330
6,022,263 A * 2/2000 Liu et al. ..... 446/379
6,042,451 A * 3/2000 Feldman ..... 446/330
6,071,170 A * 6/2000 How ..... 446/330
6,124,541 A * 9/2000 Lu ..... 84/600
6,126,508 A * 10/2000 Chou ..... 446/358
6,163,992 A * 12/2000 Chou ..... 40/411
6,200,191 B1 * 3/2001 Chou ..... 446/353
6,224,456 B1 * 5/2001 Wittenberg ..... 446/330
6,227,931 B1 * 5/2001 Shackelford ..... 446/268
6,296,543 B1 * 10/2001 Andrews ..... 446/334
6,422,916 B1 * 7/2002 Enku ..... 446/330
6,439,952 B1 * 8/2002 Yamamura ..... 446/383
6,450,855 B1 9/2002 Tang
6,482,068 B2 * 11/2002 Lee et al. ..... 446/376
6,537,130 B1 * 3/2003 Lee et al. ..... 446/375
6,572,433 B1 * 6/2003 Hou ..... 446/353
6,575,810 B1 * 6/2003 Sohn ..... 446/485
6,579,143 B1 * 6/2003 Rehkemper et al. ..... 446/330
6,682,392 B2 * 1/2004 Chan ..... 446/335
6,692,332 B2 * 2/2004 Jheow ..... 446/383
6,817,921 B2 * 11/2004 Chin et al. ..... 446/376
6,830,497 B1 * 12/2004 Lee et al. ..... 446/376
6,863,583 B2 * 3/2005 Takahashi ..... 441/74
6,863,587 B1 * 3/2005 Bennett ..... 446/297
6,869,331 B2 * 3/2005 Lee et al. ..... 446/376
6,887,121 B2 * 5/2005 Whitehead ..... 446/129
6,893,315 B2 * 5/2005 Barri ..... 446/92
6,937,152 B2 * 8/2005 Small ..... 340/568.1
7,059,934 B2 * 6/2006 Whitehead ..... 446/477
7,128,691 B2 * 10/2006 Cottrell ..... 482/3
7,318,766 B2 * 1/2008 Marine et al. ..... 446/359
2004/0198139 A1 * 10/2004 Atobe et al. ..... 446/74
2005/0191936 A1 * 9/2005 Marine et al. ..... 446/376
2007/0128973 A1 * 6/2007 Blagg et al. ..... 446/334
2007/0149089 A1 * 6/2007 De La Torre ..... 446/373
2010/0048092 A1 * 2/2010 Kenney ..... 446/334

* cited by examiner

POSE AND PLAY DOLLS

BACKGROUND OF THE INVENTION

1. Field of the Invention

The present invention relates to the field of dolls, and more particularly, to animated dolls.

2. Prior Art

Dolls of various kinds, shapes, sizes, materials and construction are well known in the prior art. Also known are dolls having some form of animation. Typically animation is provided by a power source such as battery power with internal sound generation and motor driven internal linkages coupled to move one or more body parts, such as eyes and mouth, as in the Teddy Ruxpin Talking Teddy Bear popular a number of years ago. Alternatively, the animation mechanism and power source may be provided under a platform on which the doll stands to provide some form of animation in the doll. By way of example, U.S. Pat. No. 6,887,121 discloses a toy comprising a flexible doll with magnets in the doll's feet to hold the doll upright on a platform. In one embodiment, one foot is magnetically held stationary with the position of the other foot being manipulated to simulate dance by the motion of a magnet under the platform on which the doll is standing. Magnets may also be placed in the hands of the doll to similarly be attracted to a fixed metal bar. Thus the source of the animation is entirely external to the doll. The doll, however, is removable from the platform for other play by physically overcoming the magnetic attraction of the doll's feet to the platform on which it may be standing.

U.S. Pat. No. 5,941,756 discloses a motion toy which provides motion in a mechanism above a platform through a drive system beneath the platform. No application of the mechanism to dolls is mentioned.

U.S. Pat. No. 6,022,263 discloses mechanical toy figures which are mechanically animated as powered by springs within the mechanical toy figures after the mechanical toy figures are set to an initial starting condition. Various body part motions are coordinated by mechanisms within the figures.

U.S. Pat. No. 6,126,508 discloses a motion toy which includes animation mechanisms within the doll-like toy that are, in effect, mechanically powered from a source of power in the platform on which the motion toy stands. That motion comprises a sidewise tilting of one leg of the toy, causing the second leg to similarly tilt, moving the hips of the toy in a first sidewise direction, causing the mechanism to somewhat rotate the body in the opposite direction and to tilt the head in the same direction as the legs. The toy is permanently mounted on the platform on which it stands.

U.S. Pat. No. 6,200,191 discloses a structure of motion toy having a somewhat similar motion as the '508 patent. In this motion toy the hips move sidewise while the body tilts somewhat in an opposite direction, no head being shown on the toy illustrated. The toy is powered by a motor within the toy, though no source of power for the motor is disclosed. The toy is self contained, apparently intended to stand upright on any flat surface.

In U.S. Pat. No. 4,676,764 a dancing doll with hip movement and 180° rotation is disclosed. The doll stands on a rotatable platform driven in rotation, with a cam raising and lowering one leg, causing the hips to move side to side.

In U.S. Pat. No. 4,040,206, a base and rotatably mounted doll with relatively moveable parts is disclosed. The doll stands on a platform with a manually operated drive mechanism in the platform for rotating a rod up through the leg of the doll. The leg may be fixed or allowed to rotate, in the first case, mechanism within the doll being powered by the rod in the leg cause animation of the doll, whereas in the second case, the doll simply rotates about that leg.

U.S. Pat. No. 5,412,890 discloses a nested turntable arrangement for electronically animated characters. The nested turntable arrangement has a base turntable rotatable about a base axis and pedestal turntables supported on the base turntable for independent rotation about separate pedestal axes. It is stated that animated characters are mounted on the pedestal turntables that have an arm body part segment whose hand ends can be extended and brought into juxtapose position approximate the base axis under rotation of the pedestal turntables. No animation of the individual characters is shown other than the rotation of the character by rotation of the respective pedestal. Proportional feedback of the base turntable rotation and the pedestal turntables rotation is disclosed.

Finally, in U.S. Pat. No. 6,682,392 physically interactive electronic toys are disclosed. Each electronic toy has at least one moving part and comprises a preprogrammed integrated circuit in at least one electric motor adapted to perform actions. Multiple such toys may be interconnected in different combinations and programmed to interact in groups of two or more. Each electronic toy is in the form of a character mounted on a rotating table which may be plugged into a similar toy for coordinated action of the electronic toy. The rotating table is shown to support a human-like character with the figure containing multiple electric motors adapted to move specific moving parts of the figures in specific ranges of motion. Only one such motor is shown for simple head rotation and no details are provided as to how power is supplied to those motors, though they are controlled from the base of the toy. No details are provided with respect to the animation mechanism in the character or the mounting of the character on the rotating table.

DETAILED DESCRIPTION OF THE PREFERRED EMBODIMENTS

Figure 1A:
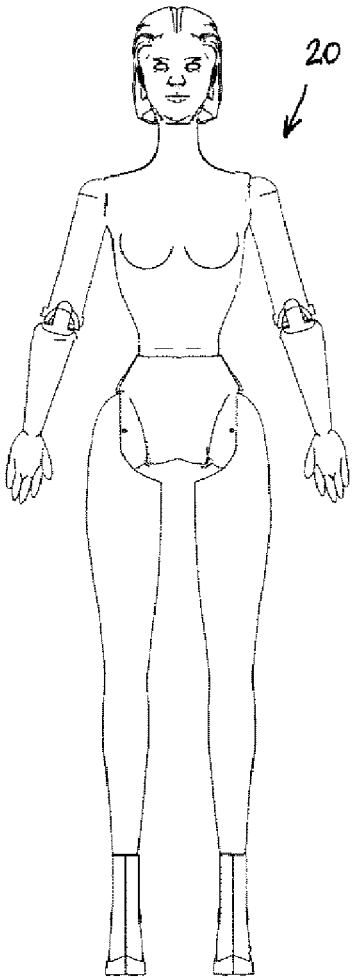
FIGS. 1*a*, 1*b* and 1*c* are front, side and perspective views of a doll in accordance with one embodiment of the present invention.
Figure 1B:
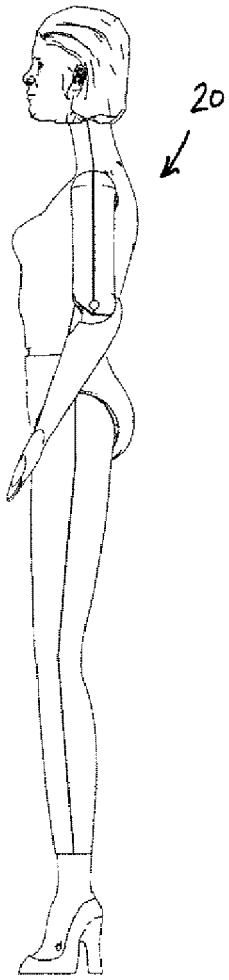
Figure 1C:
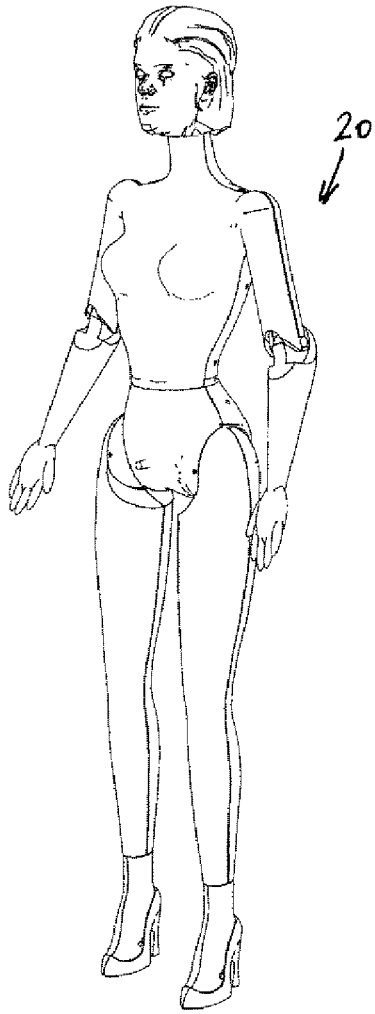

The present invention comprises animated dolls that removably stand on a platform by magnetic attraction, but are physically removable from the platform for other play. The dolls are electrically powered by contacts in the doll feet cooperatively disposed with respect to electrical contacts on the platform. In preferred embodiments, the dolls are fashion dolls, and as such, are of rather trim physiques not allowing for containment within the doll of significant electrical power for the animation, hence the electrical power and control from the platform. From Wikipedia, the free encyclopedia on the Internet, fashion dolls are defined as "dolls designed to be dressed and redressed to reflect fashion trends or occasionally fantasy play. The dolls are typically plastic or vinyl, and are manufactured both as toys and as collectibles. They are enjoyed by many age groups. The dolls are usually modeled after teen girls or adult women. Sizes range from 10.5 inches (270 mm) to 24 inches (610 mm). There are of course some special cases that fall outside this range. 11.5 inches (290 mm) is the size of the Barbie doll, by Mattel, who set quite a standard for many years in this arena."

In the description to follow, various embodiments are disclosed. All include a doll that stands by magnetic attraction in a specific location on a platform that rotates and receives electrical power from the platform to power some form of animation in the doll, such as sound, lights and/or physical motion of one or more body parts. In one embodiment disclosed, head, body and arm movements are provided by control of a single animation motor in the body using proportional feedback back to a controller in the base supporting the platform for more lifelike doll motion. In one incarnation of this embodiment, each arm moves as a unit, though the bend of the elbow may be manually preset, while in another incarnation, upper and lower arm segments move relative to each other in unison with the upper arm motion. In another embodiment, the legs are individually rotatable relative to the hips through at least a limited angle to allow sidewise motion of the hips by tilting of the doll feet.

There are also various embodiments of the base supporting the platform. In one base embodiment the platform simply rotates, though the angular rotation is controllable so that the platform may be rotated back and forth through different angles as a partial simulation of dancing. In another embodiment the magnetically preferred doll feet positions on the platform are each tiltable about a respective one of two axes, the two axes being in a plane substantially parallel to the remaining surface of the platform and each generally aligned with the length of the respective doll foot, whereby tilting the foot surfaces in unison with the doll standing on the platform will cause the dolls' hips to move side to side. This tilting is achieved in the specific embodiment disclosed by a cam action active on rotation of the platform. The remaining animation of the doll may be as previously described, resulting in body, arm and head motion.

First referring to FIGS. 1*a,* 1*b* and 1*c,* views of an exemplary doll 20 in accordance with some embodiments of the present invention may be seen. In these and other embodiments, the basic doll size is the same as the well known Barbie doll, a convenient size to use because of its general acceptance, and the fact that doll clothes are widely available for dolls of this size.

Figure 2A:
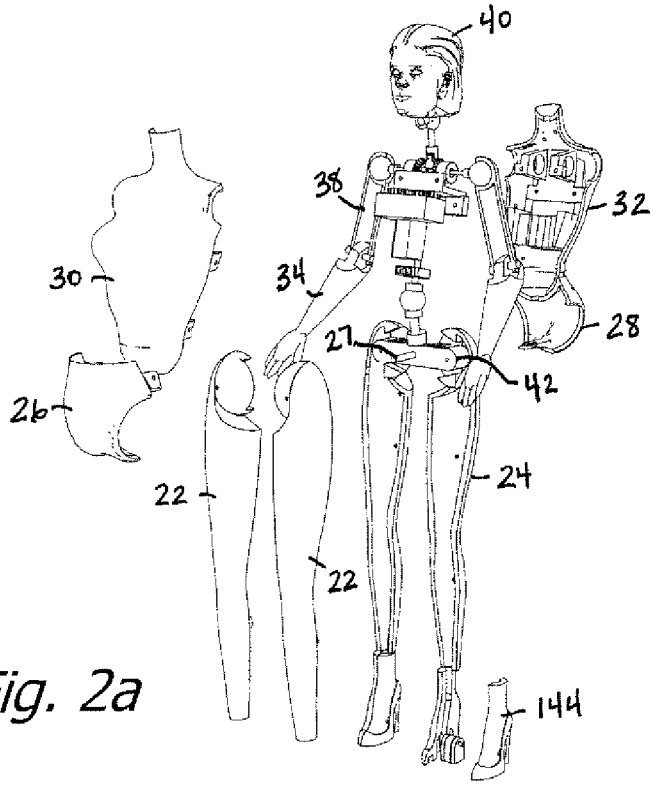
FIGS. 2*a* through 2*d* are exploded views illustrating the construction of the body of the doll of FIGS. 1*a* through 1*c*.
Figure 2B:
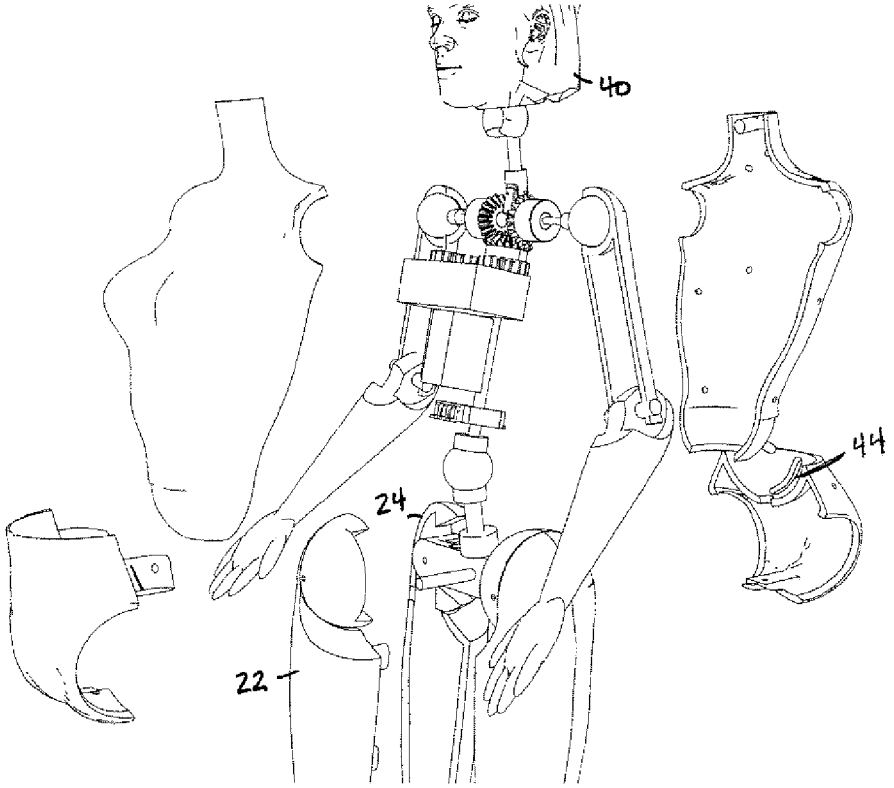

An exploded view of a doll 20 may be seen in FIG. 2*a,* and a portion of the doll 20 taken on an expanded scale may be seen in FIG. 2*b.* The doll exterior is comprised of front and back leg members 22 and 24, front abdomen panel 26 and adjoining rear panel 28, chest and back panels 30 and 32, lower arm members 34, front and back upper arm panels 36 and 38, only the back upper arm panel 38 being shown for clarity, and head 40. The front arm panel is shown in FIG. 3*a,* and the feet are subsequently described.

Figure 2C:
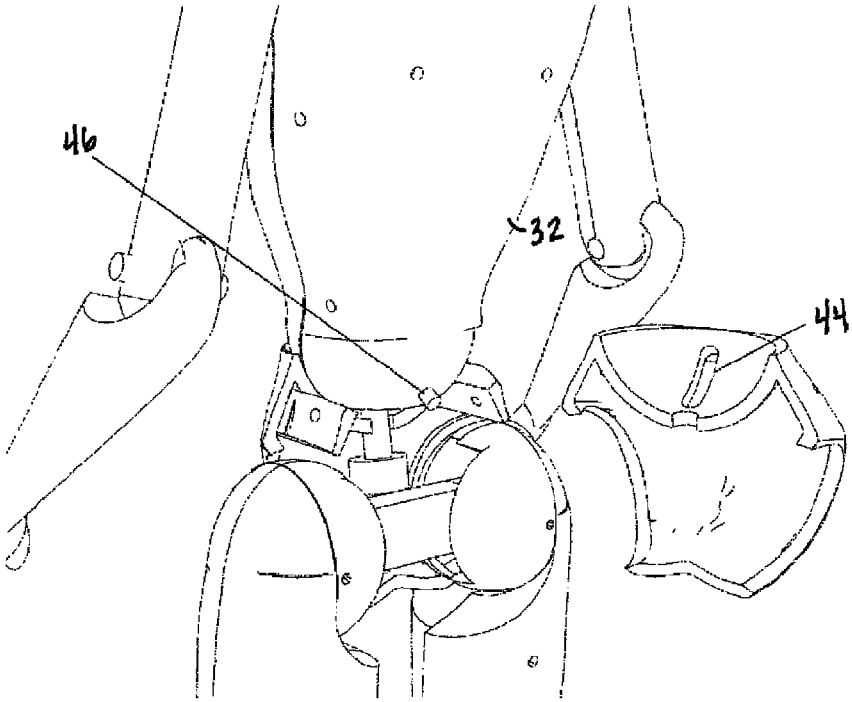
Figure 2D:
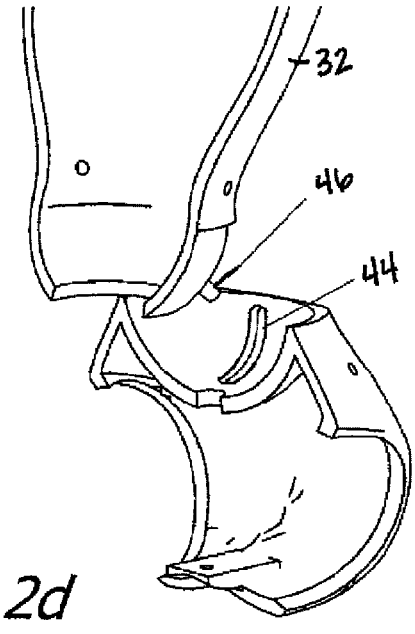

As may be seen in FIGS. 2*a* and 2*b,* the front and back leg members 22 and 24 are hinged with respect to an internal hip member 42 in a manner subsequently described in detail. As shall subsequently be seen, the hip member 42 is attached to front abdomen panel 26 through pin 27 to provide a reference for the body, arm and head motion. The attachment to the legs of the hip member 42 also prevents rotation of the hip member 42 about a vertical axis, but allows rotation of hip member around pin 27. Accordingly, front abdomen panel 26 and rear abdomen panel 28 are also affixed to each other. The rear abdomen panel 28 has a slot 44 therein, visible in FIG. 2*b,* though more apparent in FIGS. 2*c* and 2*d.* Pin 46 on the lower spherical portion of back panel 32 fits into slot 44 so that the upper body may lean forward and back and side to side without a component of rotation of the upper body assembly with respect to the lower body and legs about the vertical axis.

Figure 3A:
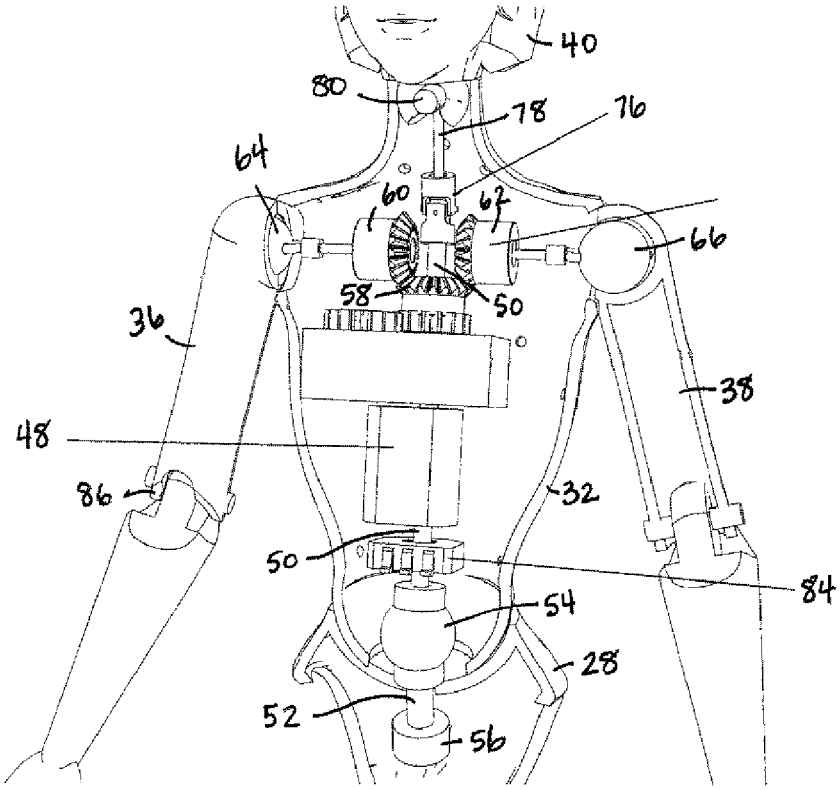
FIGS. 3*a* and 3*b* are illustrations of the arm and head, hip and torso motion drive mechanisms.
Figure 3B:
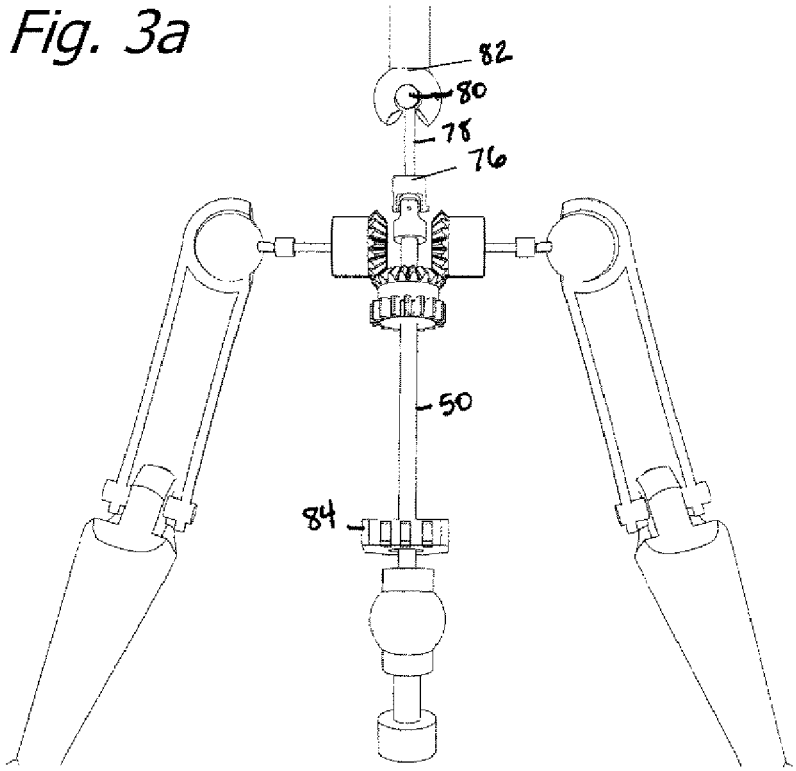

Now referring to FIGS. 3*a* and 3*b,* certain details of the internal mechanism of this embodiment of doll may be seen. Mounted to the back panel 32 is a gear motor 48 driving a shaft 50 connected to a shaft 52 through a coupling 54. Shaft 52 is supported at the bottom on a retainer 56 and guided by the opening between front abdomen panel 26 and back abdomen panel 28, with coupling 54 connecting shaft 50 thereto at a significant angle with respect thereto. Consequently, rotation of shaft 50 by motor 48 will also cause rotation of coupling 54 and shaft 52 relative to the lower body, and of course relative to the upper body assembly, as pin 46 (see FIG. 2*b*) prevents rotation of the upper body with respect to the lower body. The rotation of shafts 50 and 52 therefore will cause the upper body to move with a conical motion about the lower body. At the same time, gear 58 fastened to shaft 50 will rotate gears 60 and 62 in opposite directions, causing the upper arms to swing in opposite directions. In that regard, the upper arms are fastened to the shafts coupled to gears 60 and 62 by ball joints 64 and 66. These ball joints allow the quiescent arm position to be adjusted, though of course still provide for the swinging of the arms as described below.

Figure 4A:
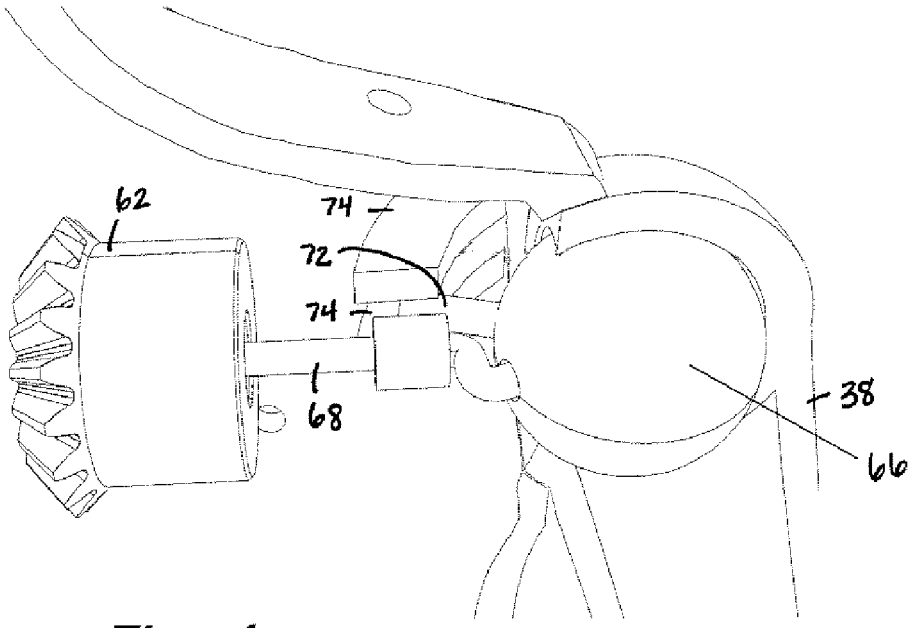
FIGS. 4*a* through 4*c* are further illustrations of the arm motion drive mechanism.
Figure 4B:
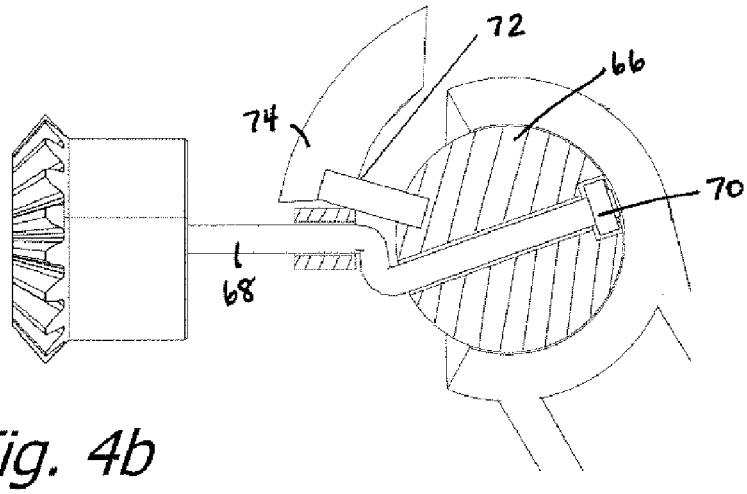
Figure 4C:
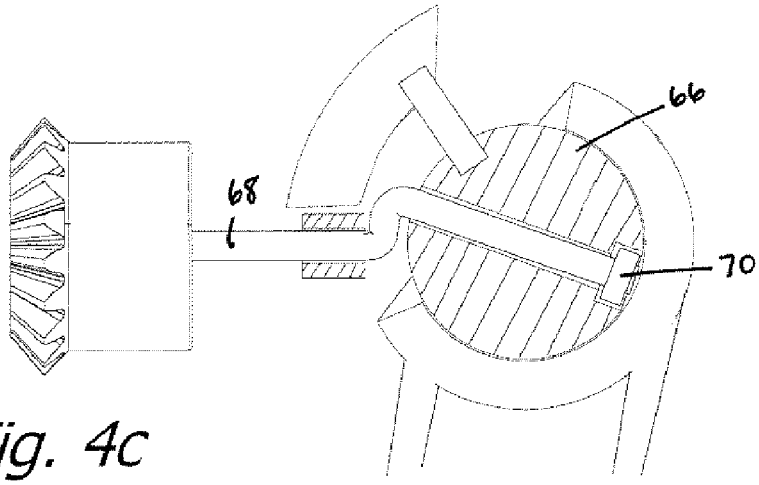

The drive of the balls 64 and 66 of the shoulder ball joints is illustrated in detail in FIGS. 4*a,* 4*b* and 4*c.* These Figures, of course, illustrate the arm on the right side of FIGS. 3*a* and 3*b,* the left arm of the doll. Gear 62 drives shaft 68 which is bent as best seen in FIG. 4*b,* with the shaft passing through the center of the ball 66, and with end piece 70 retaining ball 66 on shaft 68. Attached to ball 66, as may be seen in FIG. 4*a,* is a pin 72 retained for substantially horizontal motion between pin guides 74. With the plane of the bent shaft in the plane of the guides 74 (substantially horizontal) as in FIG. 4*a,* the ball is somewhat rotated about the vertical axis to turn the doll's hand outward. If the bent shaft were rotated 180 degrees, the doll's hand would be somewhat rotated about the vertical axis to turn the doll's hand inward. Rotating the bent shaft 90 degrees in one direction will cause the doll's arm to rotate forward, and 90 degrees in the other direction will cause the doll's arm to rotate backward. Consequently, moving the bent shaft 68 through an angle centered about the position shown in FIG. 4*a* will cause the arm to swing forward and backward, with some attendant arm twist adding to the visual effect.

Figure 5A:
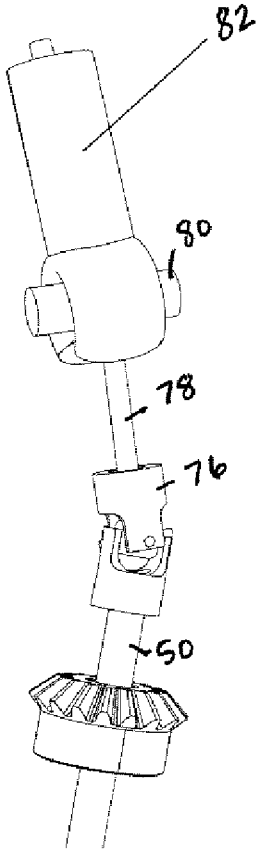
FIG. 5*a* through 5*c* are further illustrations of the head motion drive mechanism.
Figure 5B:
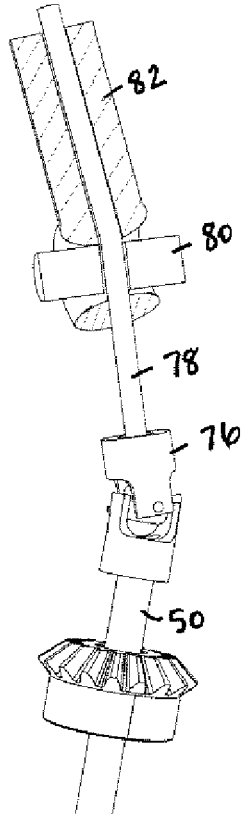
Figure 5C:
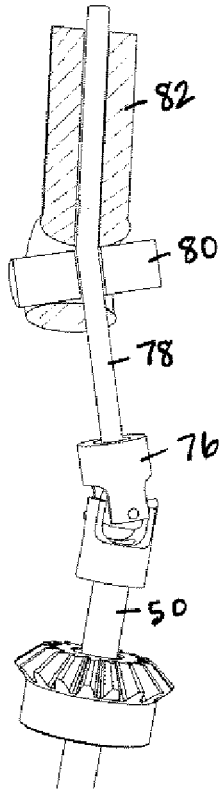
Figure 6A:
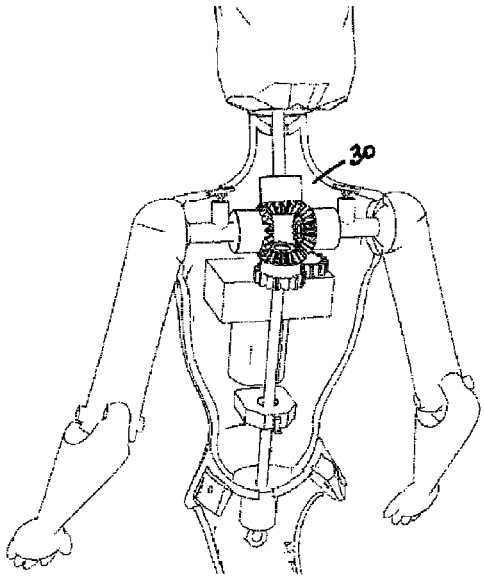
FIGS. 6*a* through 6*i* are illustrations of alternate arm and head, hip and torso motion drive mechanisms.
Figure 6C:
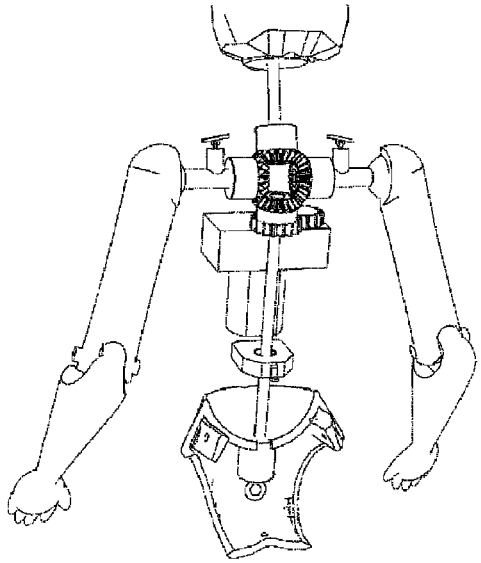
Figure 6B:
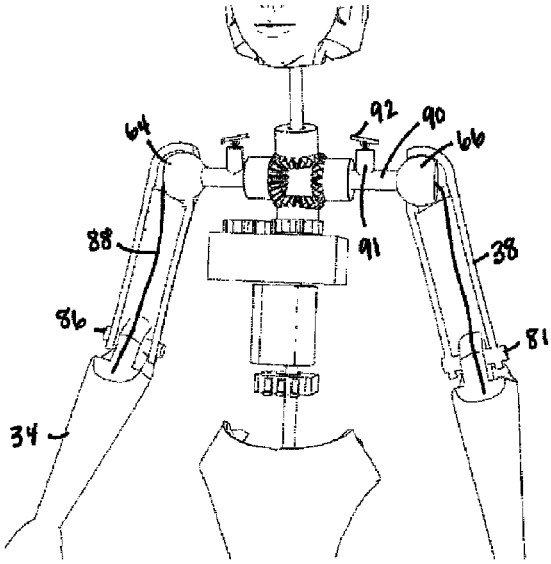
Figure 6D:
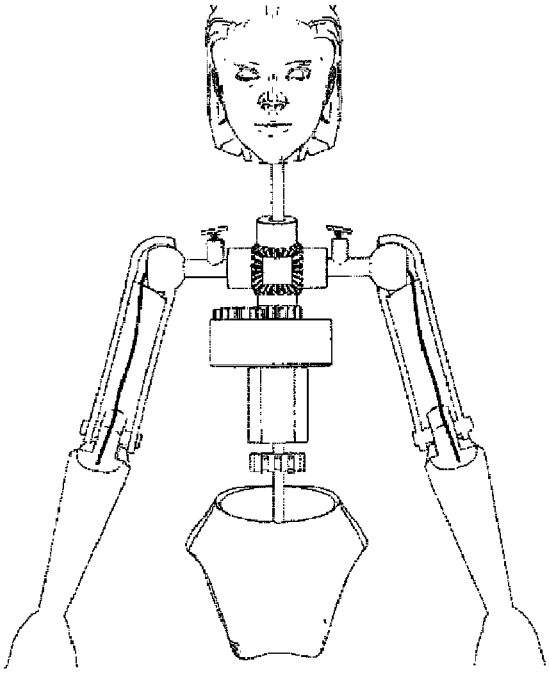
Figure 6F:
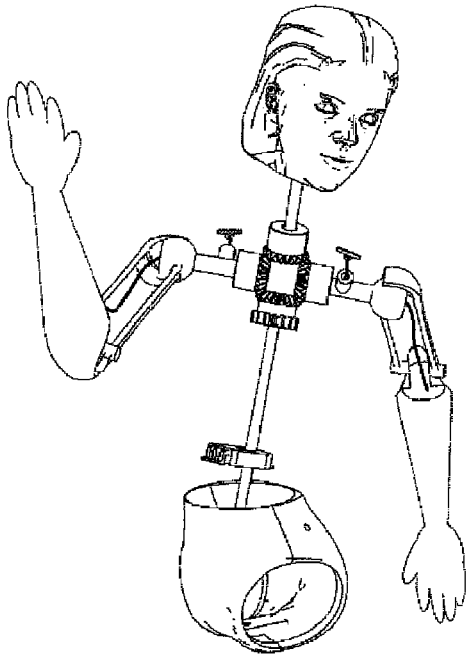
Figure 6E:
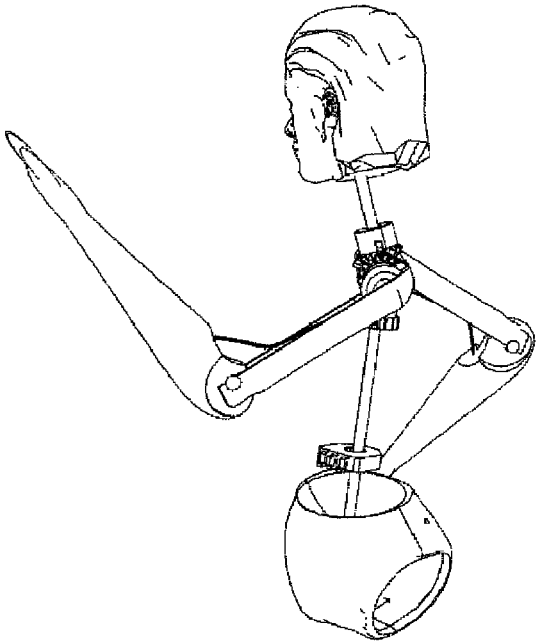
Figure 6G:
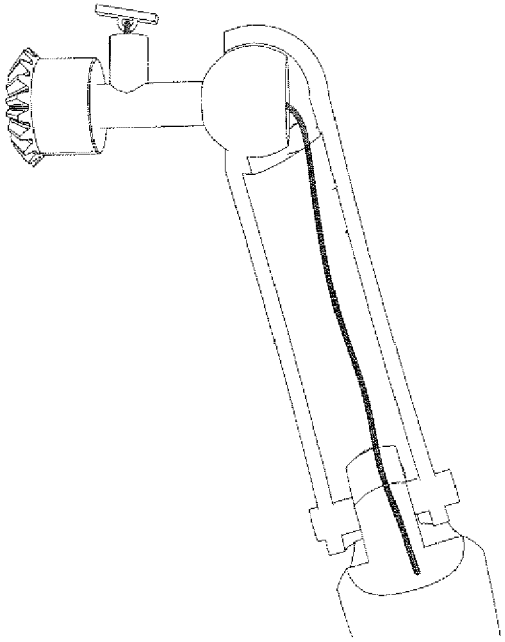
Figure 6H:
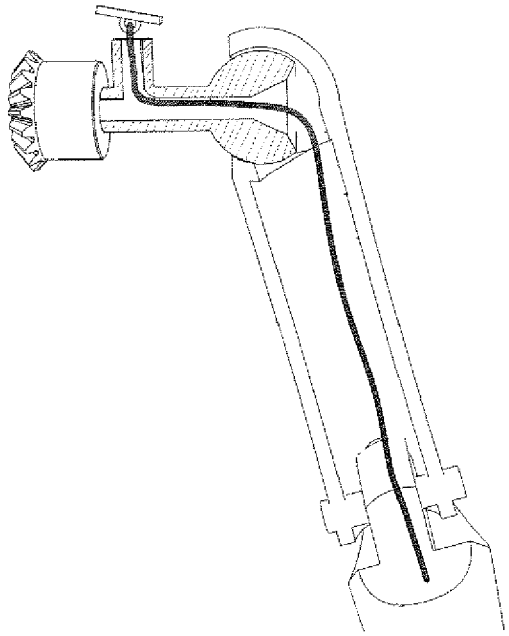
Figure 6I:
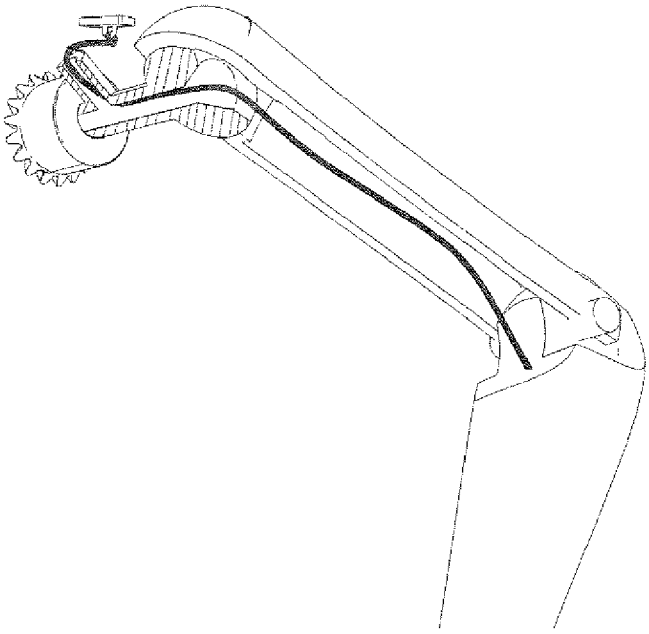

As may be best seen in FIGS. 3*a* and 3*b,* shaft 50 also drives a universal joint 76, which in turn drives a shaft 78 extending through a fixed pin 80 at the neck portion of the doll, pin 80 being best seen in FIG. 2*b.* Shaft 78 provides motion for the head 40 of the doll as shown in the illustrations of FIGS. 5*a,*

5*b* and 5*c*. In particular, shaft 78 is also a bent shaft, extending into the head region of the doll, the head 40 being rigidly attached to member 82 and restrained from substantial rotation about a vertical axis by pin 80 passing through the lower portion of member 82, pin 80 being rigidly attached to chest and back panels 30 and 32. Thus rotation of shaft 50 will cause rotation of shaft 78, which will cause the head 40 to move with a conical motion with respect to the upper body. Of course, shaft 50, giving rise to all the various body part motions just described, only rotates through a limited angle. With the gearing shown, the doll's head 40 will rotate toward either arm as it moves backward, with the upper body movement contributing to the overall realism of the animation.

Finally, as may be seen in FIGS. 2*a*, 2*b*, 3*a* and 3*b*, a potentiometer 84 is connected to shaft 50 to provide proportional feedback through connections through the legs to allow smooth control of gear motor 48.

In the embodiment just described, the elbow joints 86 are simple friction joints, allowing the lower arm portions to be manually rotated with respect to the upper arm portions, though remaining in that relative position so that the arms will each swing back and forth as a unit.

FIGS. 6*a* through 6*i* illustrate another embodiment wherein the front and back upper arm panels 36 (not shown) and 38 and the lower arm portions 34 are loosely hinged together at elbows 86 so that the lower arm members 34 may rotate with respect to the upper arm panels 36 and 38. As may be best seen in FIGS. 6*b*, 6*d*, 6*e* and 6*f*, in each arm assembly a cord 88 is attached to the lower arm member 34 at a position offset from the axis of the elbow 86 and extends upward within the upper arm panels 36 and 38 through the center of respective ball joint 64 or 66 and shaft 90 to extend outward above shaft 90 through shaft 91 and connect to anchor 92, which in turn is anchored to the chest and back panels 30 and 32. As such, rotation of shaft 90 away from the location of the anchor will cause the anchor to pull on line 88 to rotate the lower arm member 34 forward relative to the upper arm panels 36 and 38. Accordingly, depending on the position of the anchor, the arm may be outstretched when swung forward, though bent at the elbow when swung back, or vice versa, or alternatively bent forward whenever the upper arm panels 36 and 38 are swung forward or back, as in FIG. 6*e*. As suggested by the shape of the cord 88 in FIG. 6*e*, most of the cord will be within the upper arm panels 36 and 38 and in any event, normally within the doll clothes.

Figure 7A:
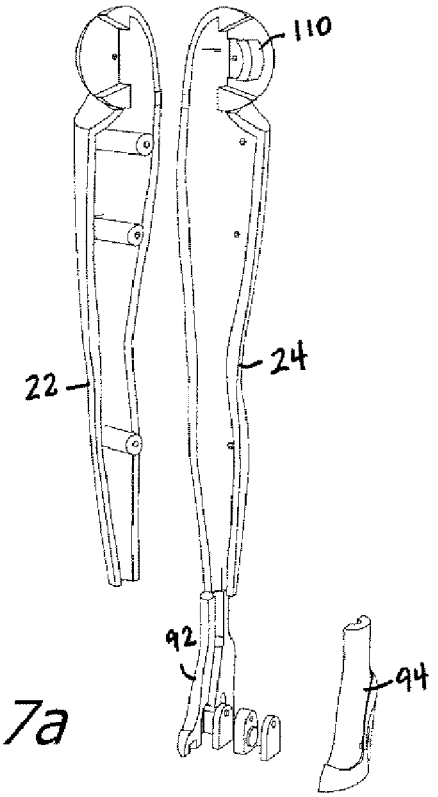
FIGS. 7*a* through 7*f* are illustrations of the hip construction.
Figure 7B:
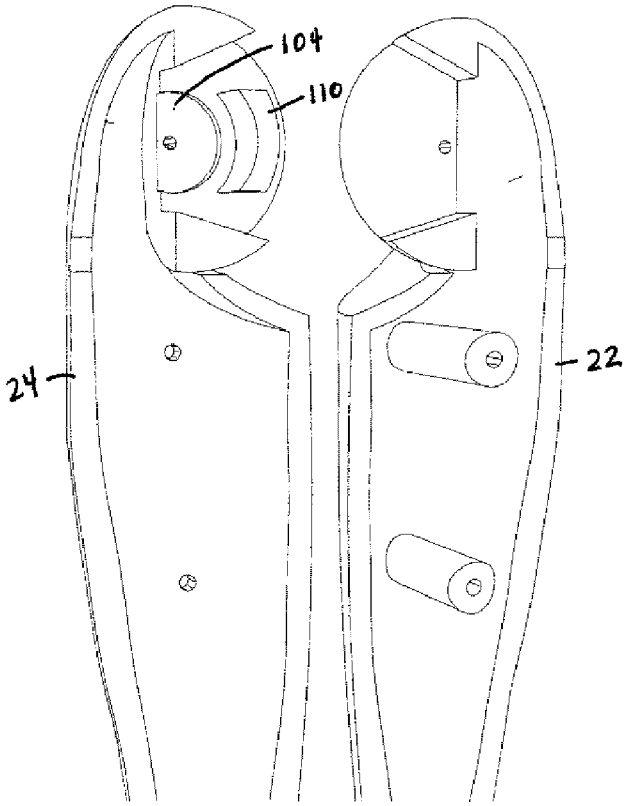
Figure 7C:
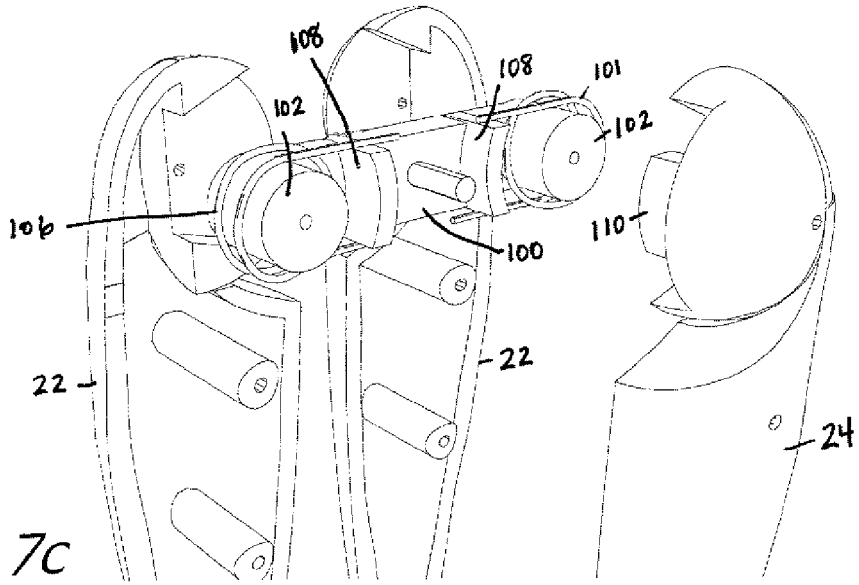
Figure 7D:
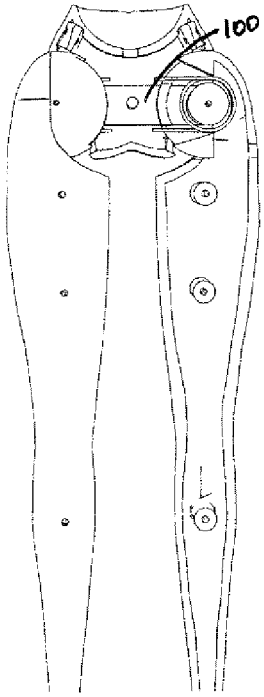

Now referring to FIGS. 7*a* through 7*f*, details of the doll's upper leg and hip portions may be seen. Each leg is comprised of a front leg member 22 and a back leg member 24, with the feet each being comprised of a left foot member 92 and a right foot member 94. As may be seen in FIGS. 7*a* through 7*f*, the front leg members 22 include standoffs 98 for fasteners extending through the back leg member 24 for tightening without distorting the leg members. The hip assembly itself is illustrated in FIGS. 7*c* through 7*f*. A hip member 100 has two spaced apart cylinders 102, each of which locates in a recess 104 in a respective one of the back leg members 24 (see FIG. 7*b*). The front and back leg members 22 and 24 are joined together by a fastener through the axis of the respective cylinder 102 so that the legs may be rotated about the cylinders for purposes which shall be subsequently described. A coil spring 106 is disposed around each of the cylinders 102, with the legs of each coil spring being kept in separation by arc segments 108 on the hip member 100. The back leg members 24 have a similar arc segment 110 (see FIGS. 7*a* and 7*b*) which also fits between the legs of the coil springs to normally hold the legs perpendicular to the hip member. However, the legs can be separated against the force the springs, or as illustrated particularly in FIGS. 7*e* and 7*f*, the hip and body of the doll may be moved right or left by deflection of the legs of the coil springs opposing the motion. In particular, in FIG. 7*d*, the legs are shown in the vertical position, though in FIG. 7*c* are tilted to the right, the lower leg of the left coil spring and the upper leg of the right coil spring being deflected by the arc segment 110 on the back leg member 24, and in FIG. 7F the opposite legs of the coils springs are similarly deflected by the arc segment 110 on the back leg member as the hip and body are moved to the left.

Figure 8A:
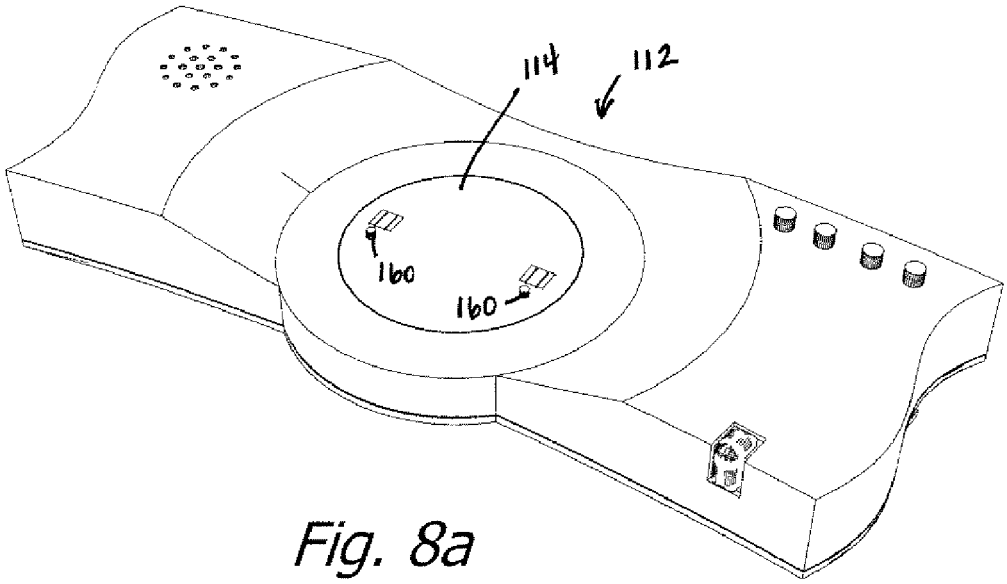
FIGS. 8*a* and 8*b* are a perspective view and an exploded view, respectively, of one embodiment of base in accordance with the present invention.
Figure 8B:
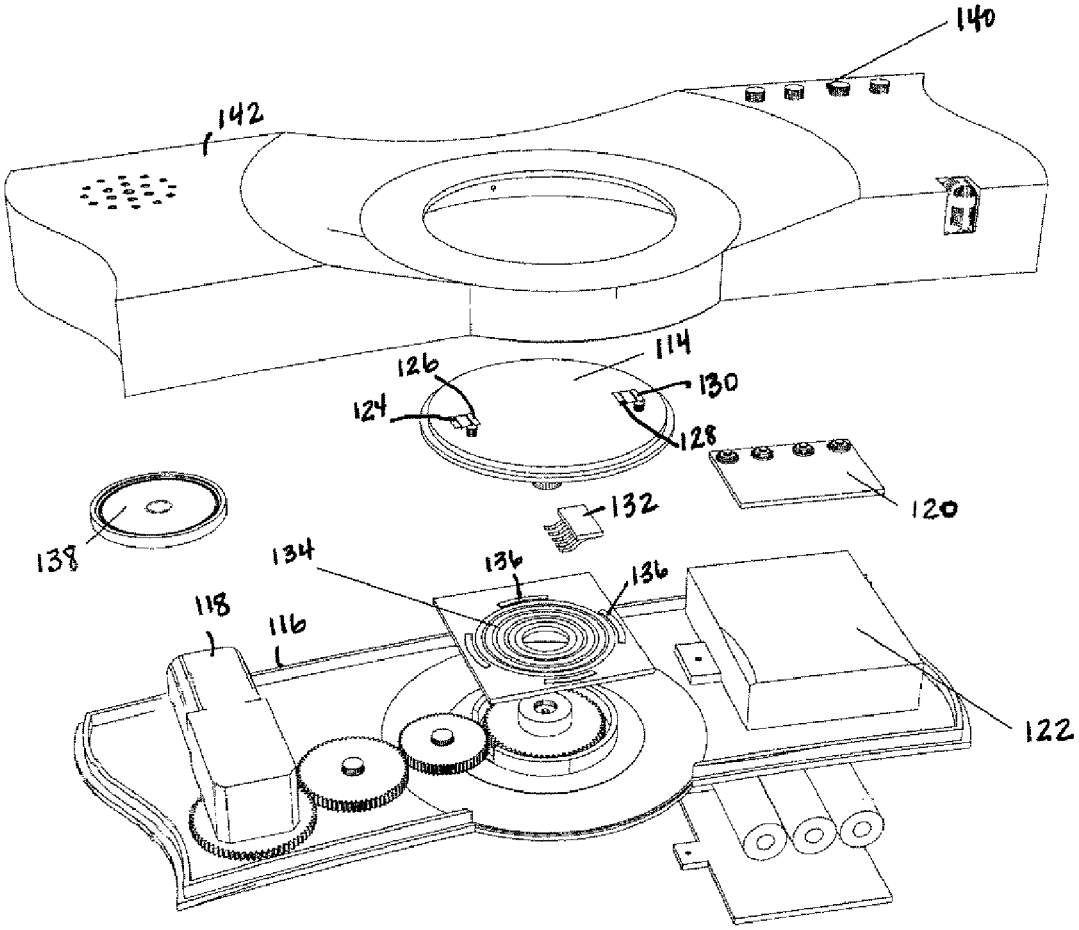

Now referring to FIGS. 8*a* and 8*b*, one embodiment base of the present invention may be seen. The base, generally indicated by the numeral 112, generally includes a platform 114 on which the doll 20 will stand in a manner subsequently described. In this embodiment, base 114 simply rotates, though may vary the angle of rotation from a full 360° or through lesser angles, as controlled by a controller within the base 112. As shall subsequently be seen, power is supplied to the gear motor 48 within the doll 20 through one leg of the doll, with the connections to the potentiometer 84 being made to the other leg. In that regard, in a preferred embodiment, the potentiometer is used simply as a variable resistor, thereby requiring only two connections as opposed to three.

FIG. 8*b* is an exploded view of the base 112 of FIG. 8*a*. The base has a bottom member 116 supporting a gear motor 118 which drives platform 114 in rotation, as controlled by a controller on circuit board 120. Batteries in a battery box 122 provide power for the motor 118 in the base and the gear motor in the doll. As shall subsequently be seen, two electrical contacts are made to one leg of the doll through iron pole pieces 124 and 126 and two electrical contacts are made to the other leg through iron pole pieces 128 and 130. One pair of the iron pole pieces, such as 124 and 126, is used to provide power to the gear motor in the doll, with the other pair, such as iron pole pieces 128 and 130, sensing the feedback variable resistor associated with the gear motor in a doll.

The electrical connection to the permanent magnets is made through wiper contacts 132 connected to the rotating platform 114 and contacting non-rotating slip rings 134. It will be noted that in addition to the five slip rings, there are four arc segments of an additional slip ring 136 and six wipers on the wiper assembly 132. The slip ring arc segments 136 are used to sense the angular position of the platform 114. In particular, in a preferred embodiment the wiper positioned to contact the arc segments 136 is electrically shorted on the wiper assembly 132 to the adjacent wiper which always has a voltage thereon so as to be able to sense the position of the platform 114 by the presence or absence of the corresponding voltage on an O-ring arc segment 136. Also shown in FIG. 8*b* is a speaker 138 for playing music coordinated with the animation in the doll, all controlled by a controller on circuit board 120, with a plurality of control buttons 140 on the cover 142 for on/off control, selecting programs, etc. The wiring, per se, is not illustrated in these Figures so as to avoid obscuring the mechanical arrangement.

Figure 9A:
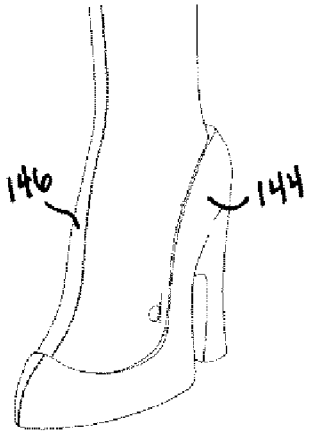
FIG. 9*a* through 9*f* are illustrations showing the construction of the doll feet and one embodiment of the mating part of the platform on the base.
Figure 9B:
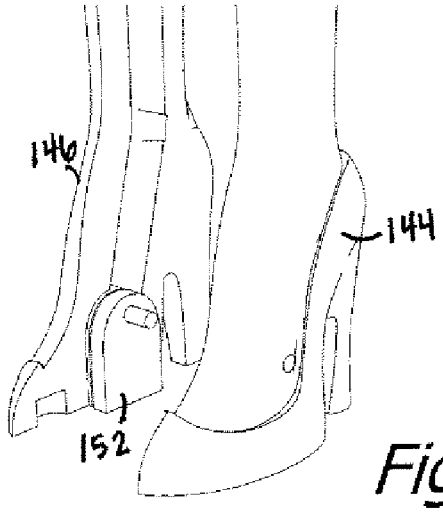
Figure 9C:
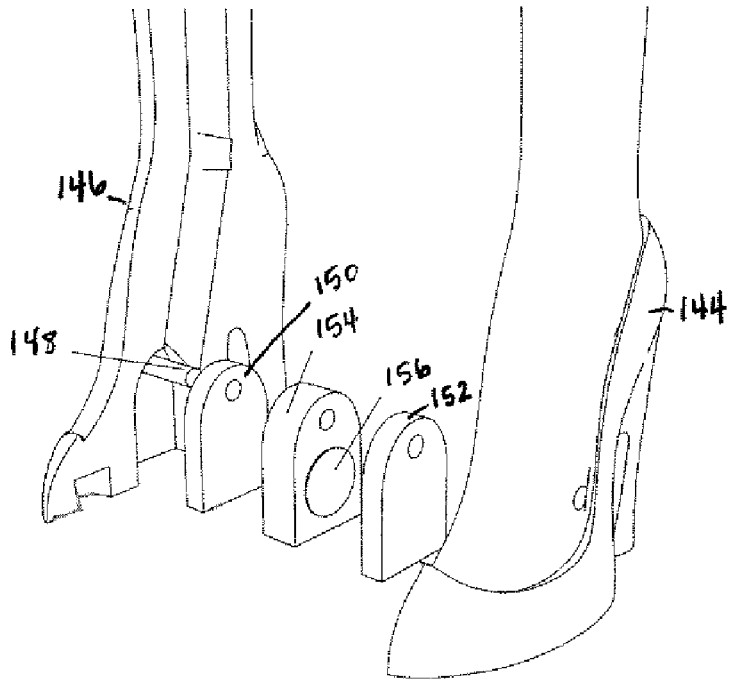
Figure 9D:
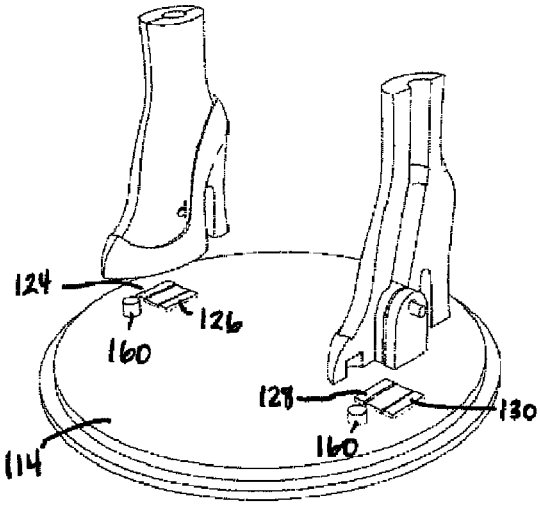
Figure 9E:
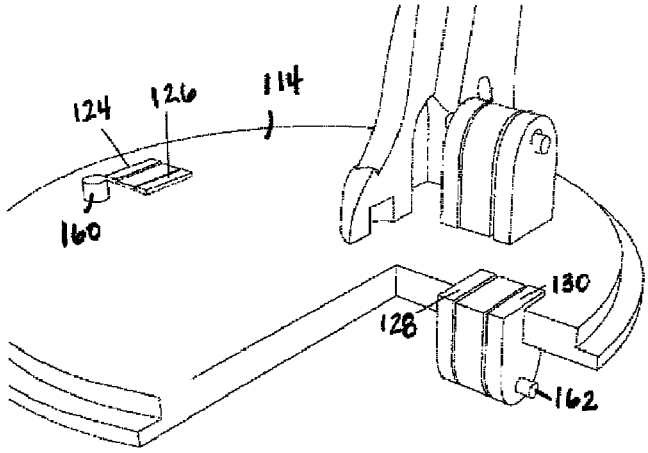
Figure 9F:
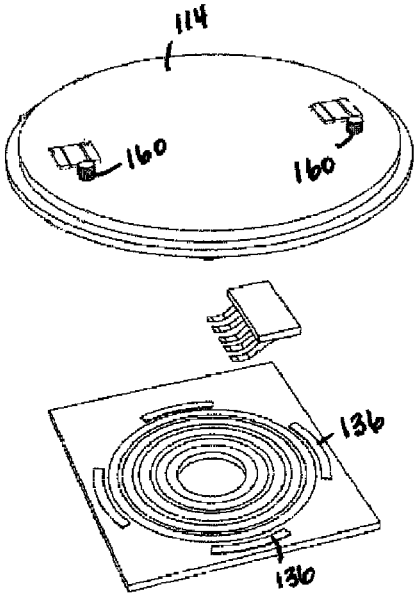

Now referring to FIGS. 9*a*, 9*b* and 9*c*, details of the structure of each foot of a doll in accordance with the present invention may be seen. Each foot is comprised of a left foot member 144 and a right foot member 146. Between the left foot member 144 and the right foot member 146 is a pin 148 which supports iron pole pieces 150 and 152, spaced apart by a plastic member 154 having a permanent magnet 156 therein. The permanent magnet 156 is electrically insulated from iron pole pieces 150 and 152 such as by a thin insulative layer on the magnet itself, on one or both iron pole pieces 146 and 148, by an insulative member positioned between at least one of the iron pole pieces 150 and 152 and the permanent magnet, or by making the plastic member 150 slightly thicker than the permanent magnet is long. In the event that Ceramic magnets are used there is no need for insulation as Ceramic magnets are electrically non-conductive. In any case, however, it is preferable to keep the non-magnetic gap created by that insulation as thin as reasonably possible. Also, in this assembly the iron pole pieces 150 and 152 extend downward past the lower surface of plastic member 154 and are free to rotate about pin 148 through a very limited range. Finally, depression 158 in the left and right foot members 144 and 146 define a positioning recess in the foot assembly which both receive locating pins 160 on the rotating platform 114 (see FIG. 8*a*). This is also better illustrated in FIGS. 9*d*, 9*e* and 9*f*. These Figures illustrate not only the magnet assemblies in the doll feet, but also complementary magnet assemblies in the platform 114. As may be seen particularly in FIG. 9*e*, complementary iron pole pieces 128 and 130, also insulated from each other, are supported on pin 162 so as to also have a certain degree of looseness on the pin. The iron pole pieces 128 and 130 are separately electrically connected to the controller. Thus when the doll is in place on the platform 114, the feet are located by pins 160, and electrical contact to the doll is made through the iron pole pieces. In that regard, only one set of complementary pole pieces need have a magnet therein, provided the other set of pole pieces are closely magnetically coupled, though it is preferred that magnets be used in conjunction with each set of iron pole pieces to provide greater attraction, and particularly to repel the doll feet where there is an attempt to place the doll on the platform backwards.

Thus when the doll is in place on the platform 114, the doll's body and head may gyrate or rotate, and the arms swing to the music played by the controller, with bending of the elbows if the doll is so configured, as the platform 114 rotates in a controlled manner back and forth through angular increments as defined by the start and ends of the slip ring arc segments 136.

Figure 7E:
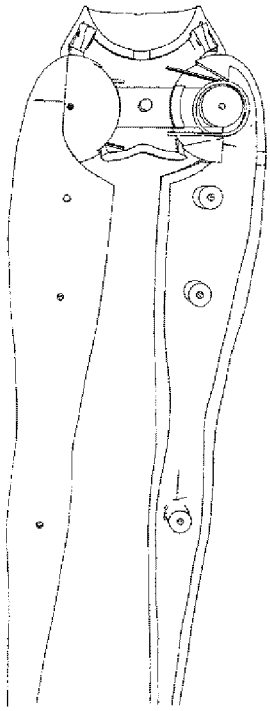
Figure 7F:
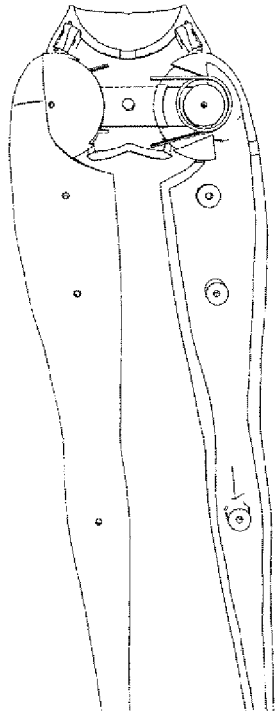
Figure 10A:
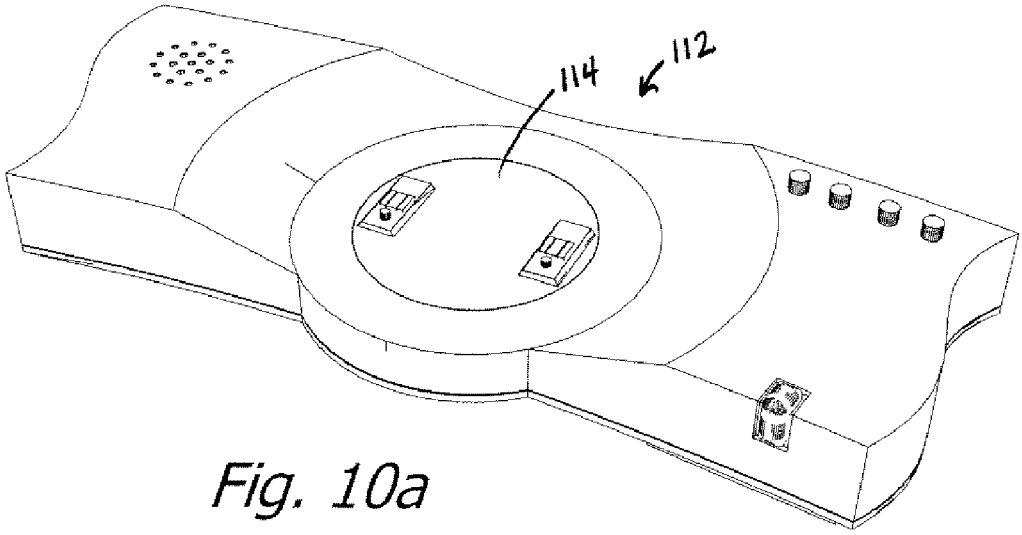
FIGS. 10*a* through 10*d* are illustrations of the structure of an alternate embodiment of base as may be used with a doll with the hip construction of FIGS. 7*a* through 7*f*.
Figure 10B:
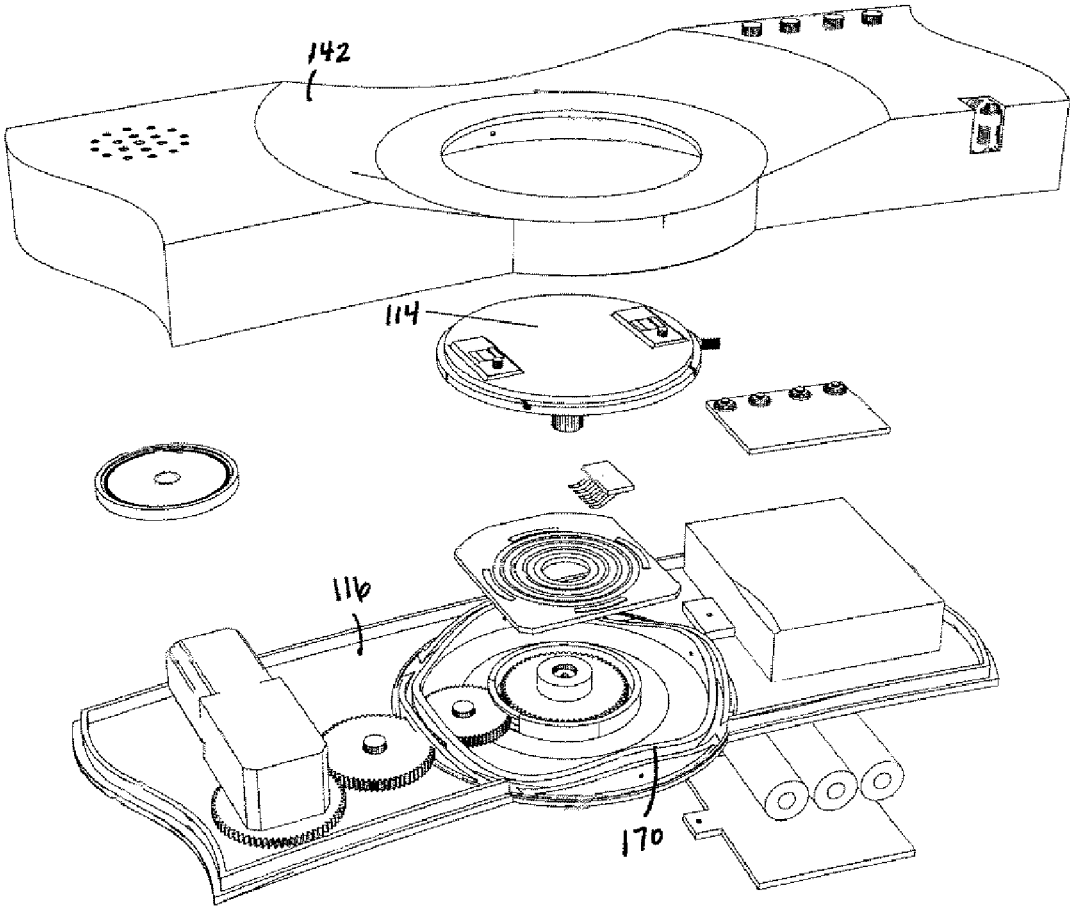
Figure 10C:
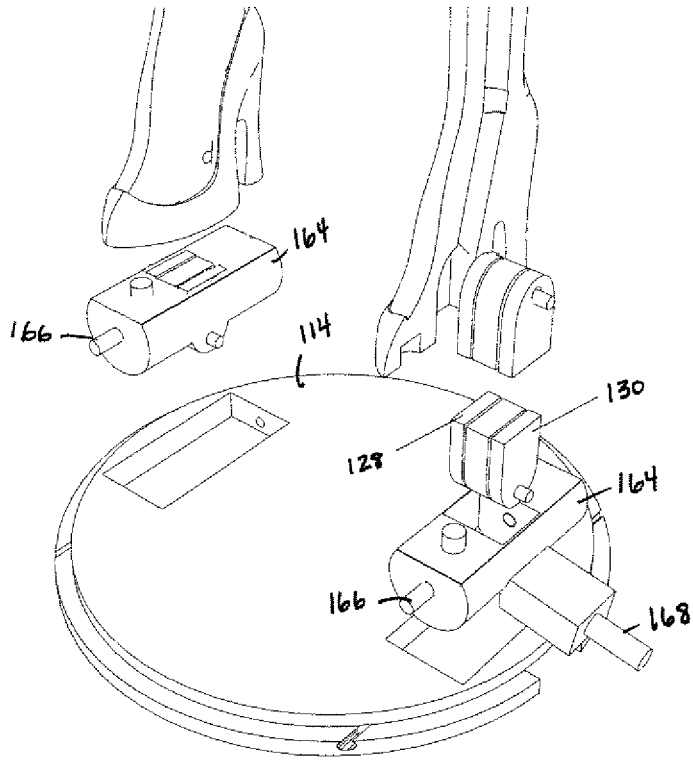
Figure 10D:
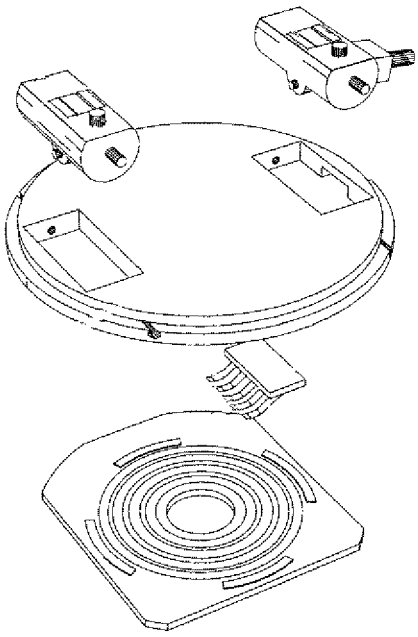

Now referring to FIGS. 10*a* and 10*d*, an alternate embodiment for the base 112 may be seen. This base is similar to that of FIGS. 8*a* and 8*b*, though differs in one important aspect. In particular, as may be best seen in FIG. 10*c*, the iron pole pieces 128 and 130 are not mounted directly on the platform 114, but rather are mounted within members 164 which pivot on axes 166. A cam follower 168 is integral with one of the members 164, with the cam follower 168 in the overall assembly being trapped between a cam or ramp 170 on the bottom member 116 and a complementary cam or ramp on the under surface of the cover 142. Thus as the platform 114 rotates, cam follower 168 will follow the cam 170, causing the corresponding one of members 164 to rotate back and forth on its axis 166 through a limited angle. This base structure would be used with a doll having a hip construction corresponding to that illustrated in FIGS. 7*a* through 7*f*, and has the effect of causing the doll's hips to move right and left as illustrated in FIGS. 7*e* and 7*f*. This, combined with the rotation of the platform through varying angles coordinated with the animation of the doll, results in a very life-like doll dancing to the music as controlled by the controller. In a preferred embodiment, only one of members 164 are driven by the cam, the other member automatically following the motion, though both members 164 may be driven by the cam or coupled together to rotate in unison.

Figure 11A:
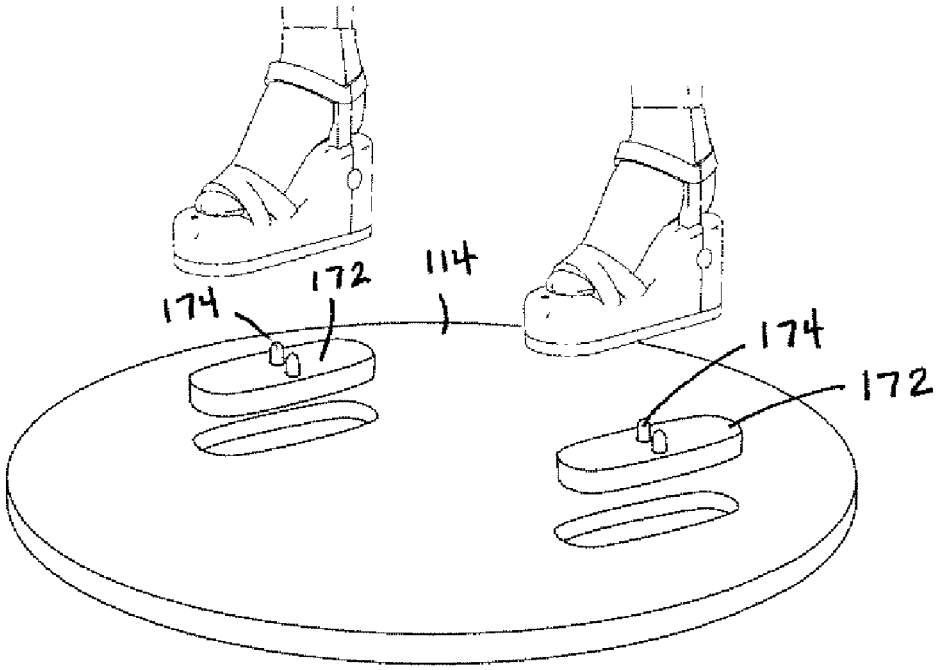
FIG. 11*a* is an exploded prospective of an alternate embodiment of platform.
Figure 11B:
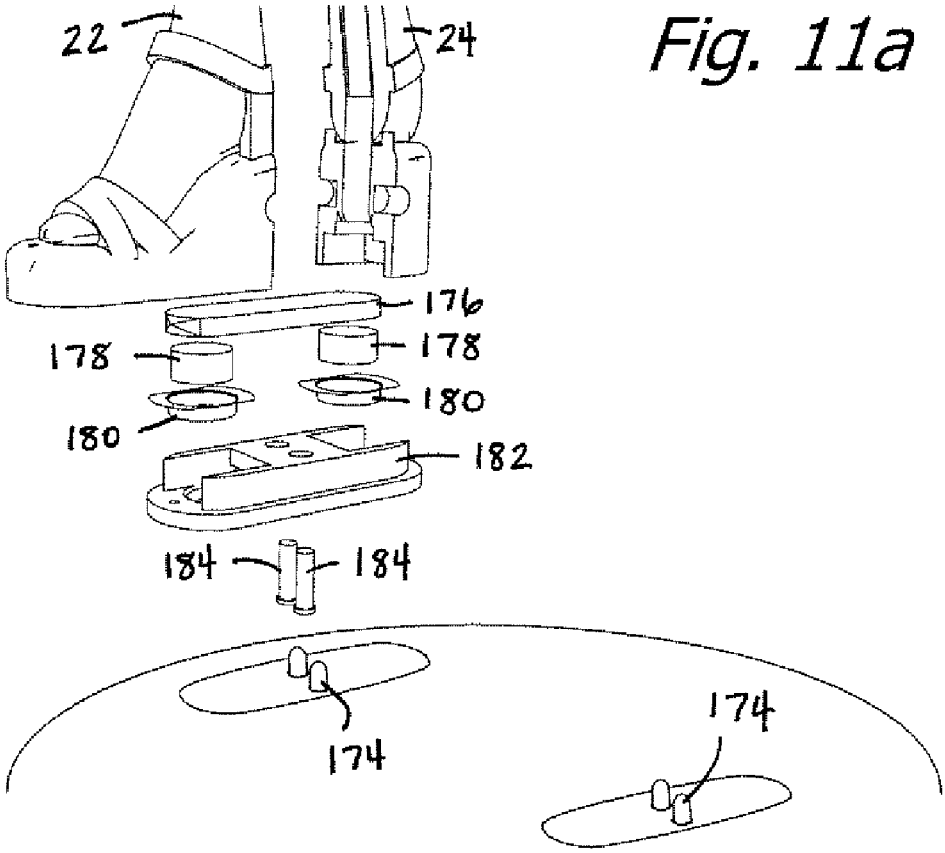
FIG. 11*b* is an exploded prospective of the alternate embodiment of platform of FIG. 11*a* and a corresponding alternate embodiment of doll foot.

FIG. 11*a* is an exploded prospective of an alternate embodiment of platform, and FIG. 11*b* is an exploded prospective of the alternate embodiment of platform of FIG. 11*a* and a corresponding alternate embodiment of doll foot. As may be seen in FIG. 11*a*, platform 114 receives and retains two iron of ferrous bars 172, each having a pair of male electrical contacts 174 fastened thereto, but electrically insulated from the bars. The base of each foot of the doll, as shown in FIG. 11*b*, contains an iron or ferrous bar 176 and two magnets 178 and caps 180, all retained by cap 182. The caps 180 are to retain the magnets, though alternatively, the cap 182 and magnets 178 may be configured to retain the magnets without the use of the caps 180. The cap 182 also has female connectors 184 therein which will mate with male electrical contacts 174 when the doll is stood up on the platform, the magnets holding the doll in the upright position without any other support for the doll.

There has been described herein various embodiments of dolls and platforms on which they may stand for varied animation, or removed for normal doll play. Thus the present invention has a number of aspects, which aspects may be practiced alone or in various combinations or sub-combinations, as desired. Also while certain preferred embodiments of the present invention have been disclosed and described herein for purposes of exemplary illustration and not for purposes of limitation, it will be understood by those skilled in the art that various changes in form and detail may be made therein without departing from the spirit and scope of the invention.

What is claimed is:

1. A doll playset comprising:

a console having a power supply and defining a platform on which a doll may stand; and a doll, at least one foot of the doll and the platform having complementary magnetic members allowing the doll to removably stand on the platform without other support, and the power supply being coupled to electrical contacts in the platform, the doll having electrical contacts in at least one foot for coupling power to at least one electrically operated device in the doll when the doll is standing on the platform, the at least one electrically operated device to provide animation to the doll.

2. The doll playset of claim 1 wherein the complementary magnetic members are permanent magnets in the platform and in each of the doll feet.

3. The doll playset of claim 2 wherein each permanent magnet has electrically conductive pole pieces, a face of each of the pole pieces in the doll feet contacting a respective face of a pole piece in the platform when the doll is standing in a preferred position on the platform, the permanent magnets having a polarity encouraging proper alignment of the doll with the platform.

4. The doll playset of claim 3 wherein the pole pieces are not rigidly mounted, thereby each being free to self adjust to mate face to face with another respective pole piece.

5. The doll playset of claim 4 wherein the pole pieces associated with at least some of the magnets are electrically isolated from each other, and form the electrical contacts.

6. The doll playset of claim 1 wherein the complementary magnetic members are permanent magnets in at least either the platform or each of the doll feet.

7. The doll playset of claim 1 wherein the electrical contacts in the platform and in the doll's foot are male and female electrical contacts.

8. The doll playset of claim 7 wherein the male electrical contacts are on the platform.

9. The doll playset of claim 1 wherein the at least one electrically operated device comprises at least one of lights, an animation motor and a sound producing device.

10. The doll playset of claim 1 wherein the at least one electrically operated device comprises an animation motor.

11. The doll playset of claim 10 further comprised of a controller in the console, the animation motor having a position feedback potentiometer coupled thereto, the animation motor and the position feedback potentiometer being coupled to the controller through contacts in the doll feet and the platform when the doll is standing on the platform.

12. The doll playset of claim 10 wherein the doll playset is configured to produce sound, the animation motor being controlled to coordinate operation of the animation motor with the sound.

13. The doll playset of claim 1 wherein the doll is a fashion doll.

14. A doll playset comprising:

a console having a power supply and defining a platform on which a doll may stand, the platform being rotatable by a motor in the console powered by the power supply; and a doll, at least one foot of the doll and the platform having complementary magnetic members allowing the doll to removably stand on the platform without other support, the power supply being coupled to electrical contacts in the platform, the doll having electrical contacts in at least one foot for coupling power to at least one electrically operated device in the doll when the doll is standing on the platform, the at least one electrically operated device to provide animation to the doll.

15. The doll playset of claim 14 wherein the complementary magnetic members are permanent magnets in each of the doll feet and complementary permanent magnets in the platform.

16. The doll playset of claim 15 wherein each permanent magnet has electrically conductive pole pieces, a face of each of the pole pieces in the doll feet contacting a respective face of a pole piece in the platform when the doll is standing in a preferred position on the platform, the permanent magnets having a polarity encouraging proper alignment of the doll with the platform.

17. The doll playset of claim 16 wherein the pole pieces are not rigidly mounted, thereby each being free to self adjust to mate face to face with another respective pole piece.

18. The doll playset of claim 17 wherein the pole pieces associated with at least some of the magnets are electrically isolated from each other, and form the electrical contacts.

19. The doll playset of claim 15 wherein surfaces of the platform on which the feet will be magnetically retained, being a plurality of foot surfaces, are each tiltable about a respective one of two axes, the two axes being in a plane substantially parallel to the remaining surface of the platform, whereby tilting the plurality of foot surfaces in unison with the doll standing on the platform may cause the dolls hips to move side to side.

20. The doll playset of claim 14 wherein the complementary magnetic members are permanent magnets in the at least one foot of the doll and the platform.

21. The doll playset of claim 14 wherein the electrical contacts in the platform and in the doll's foot are male and female electrical contacts.

22. The doll playset of claim 21 wherein the male electrical contacts are on the platform.

23. The doll playset of claim 14 wherein the at least one electrically operated device comprises at least one of lights, an animation motor and a sound producing device.

24. The doll playset of claim 14 wherein the at least one electrically operated device comprises an animation motor.

25. The doll playset of claim 24 further comprised of a controller in the console, the animation motor having a position feedback potentiometer coupled thereto, the animation motor and the position feedback potentiometer being coupled to the controller through contacts in the doll feet and the platform when the doll is standing on the platform.

26. The doll playset of claim 25 further comprised of position feedback of the platform position to the controller for control of the rotation of the platform by the controller.

27. The doll playset of claim 26 wherein the doll playset is configured to produce sound, the animation motor being controlled to coordinate operation of the animation motor with the sound.

28. The doll playset of claim 25 wherein the animation motor provides head and body motion.

29. The doll playset of claim 28 wherein the animation motor drives a bent wire to provide the head and body motion.

30. The doll playset of claim 29 wherein the animation motor also provides arm motion.

31. The doll playset of claim 29 wherein the animation motor provides upper arm motion, lower arm motion relative to the upper arm motion being provided by a link between each lower arm and the body.

32. The doll playset of claim 14 wherein the doll is a fashion doll.

33. A doll playset comprising:

a console having a power supply and a controller, the console having a platform on which a doll may stand, the platform being rotatable by a platform drive motor in the console, with position feedback, powered by the power supply and controlled by the controller; and a doll, feet of the doll and the platform having complementary magnetic members allowing the doll to removably stand on the platform without other support, the power supply being coupled to electrical contacts in the platform, the doll having electrical contacts in at least one foot for coupling power to at least one electrically operated device in the doll when the doll is standing on the platform, the at least one electrically operated device to provide animation to the doll, surfaces of the platform on which the feet are magnetically retained being a plurality of foot surfaces, the plurality of foot surfaces are each tiltable about a respective one of two axes, the two axes being in a plane substantially parallel to the remaining surface of the platform, whereby tilting the plurality of foot surfaces in unison with the doll standing on the platform may cause the dolls hips to move side to side, at least one of the plurality of foot surfaces being coupled to a cam, the cam coupled to tilt at least one of the plurality of foot surfaces on rotation of the platform, and the platform drive motor and an animation motor being controlled by the controller to coordinate the motions of the two motors.

34. The doll playset of claim 33 wherein the doll playset is configured to produce sound, the platform drive motor and the animation motor being controlled by the controller to coordinate the motions of the two motors with the sound.

35. The doll playset of claim 33 wherein the animation motor provides head and body motion.

36. The doll playset of claim 35 wherein the animation motor drives a bent wire to provide the head and body motion.

37. The doll playset of claim 35 wherein the animation motor also provides arm motion.

38. The doll playset of claim 37 wherein the animation motor provides upper arm motion, lower arm motion relative to the upper arm motion being provided by a link between each lower arm and the body.

39. The doll playset of claim 33 wherein the doll is a fashion doll.

* * * * *